US011249417B2

(12) United States Patent
Hwang et al.

(10) Patent No.: US 11,249,417 B2
(45) Date of Patent: Feb. 15, 2022

(54) TONER REFILL CONTROL USING REUSABLE REFILL APPARATUS

(71) Applicant: Hewlett-Packard Development Company, L.P., Spring, TX (US)

(72) Inventors: Sun Kye Hwang, Seongnam-si (KR); Jang Geun Kim, Seongnam-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/049,733

(22) PCT Filed: Oct. 30, 2018

(86) PCT No.: PCT/KR2018/012973
§ 371 (c)(1),
(2) Date: Oct. 22, 2020

(87) PCT Pub. No.: WO2020/009280
PCT Pub. Date: Jan. 9, 2020

(65) Prior Publication Data

US 2021/0048763 A1 Feb. 18, 2021

(30) Foreign Application Priority Data

Jul. 4, 2018 (KR) ..... 10-2018-0077743

(51) Int. Cl.
*G03G 15/08* (2006.01)
*G03G 15/00* (2006.01)

(52) U.S. Cl.
CPC ..... *G03G 15/0863* (2013.01); *G03G 15/0865* (2013.01); *G03G 15/0894* (2013.01); *G03G 15/5079* (2013.01); *G03G 15/556* (2013.01); *G03G 2215/0697* (2013.01)

(58) Field of Classification Search
CPC ..... G03G 15/0863; G03G 15/0894; G03G 15/5079
See application file for complete search history.

(56) References Cited

U.S. PATENT DOCUMENTS 6,212,338 B1 4/2001 Hagihara et al.
6,473,571 B1 * 10/2002 Wegman ..... B41J 2/17533 399/12
2011/0113469 A1 5/2011 Takahashi

FOREIGN PATENT DOCUMENTS

| | | | |
|---|---|---|---|
| EP | 1 041 455 | A2 | 10/2000 |
| JP | 2000-19803 | A | 1/2000 |
| JP | 2016-224273 | A | 12/2016 |
| JP | 2017-56619 | A | 3/2017 |
| KR | 10-2006-0060332 | A | 6/2006 |

(Continued)

*Primary Examiner* — Victor Verbitsky
(74) *Attorney, Agent, or Firm* — Jefferson IP Law, LLP

(57) ABSTRACT

An image forming apparatus is disclosed. The image forming apparatus includes a print engine to perform a printing job using toner filled in a toner cartridge, a communicator to communicate with a memory chip attached to a toner refill apparatus which refills the toner cartridge with toner, a memory to store group information corresponding to a plurality of image forming apparatuses for sharing the toner refill apparatus, and a processor to determine whether or not the toner refill apparatus is usable based on information stored in a memory chip of the toner refill apparatus and group information stored in the memory.

18 Claims, 7 Drawing Sheets

(56) References Cited

FOREIGN PATENT DOCUMENTS

| | | | |
|---|---|---|---|
| KR | 10-0693341 | B1 | 3/2007 |
| KR | 10-1011516 | B1 | 1/2011 |
| KR | 10-1198771 | B1 | 11/2012 |
| KR | 10-2015-0120107 | A | 10/2015 |

* cited by examiner

[Fig. 1]
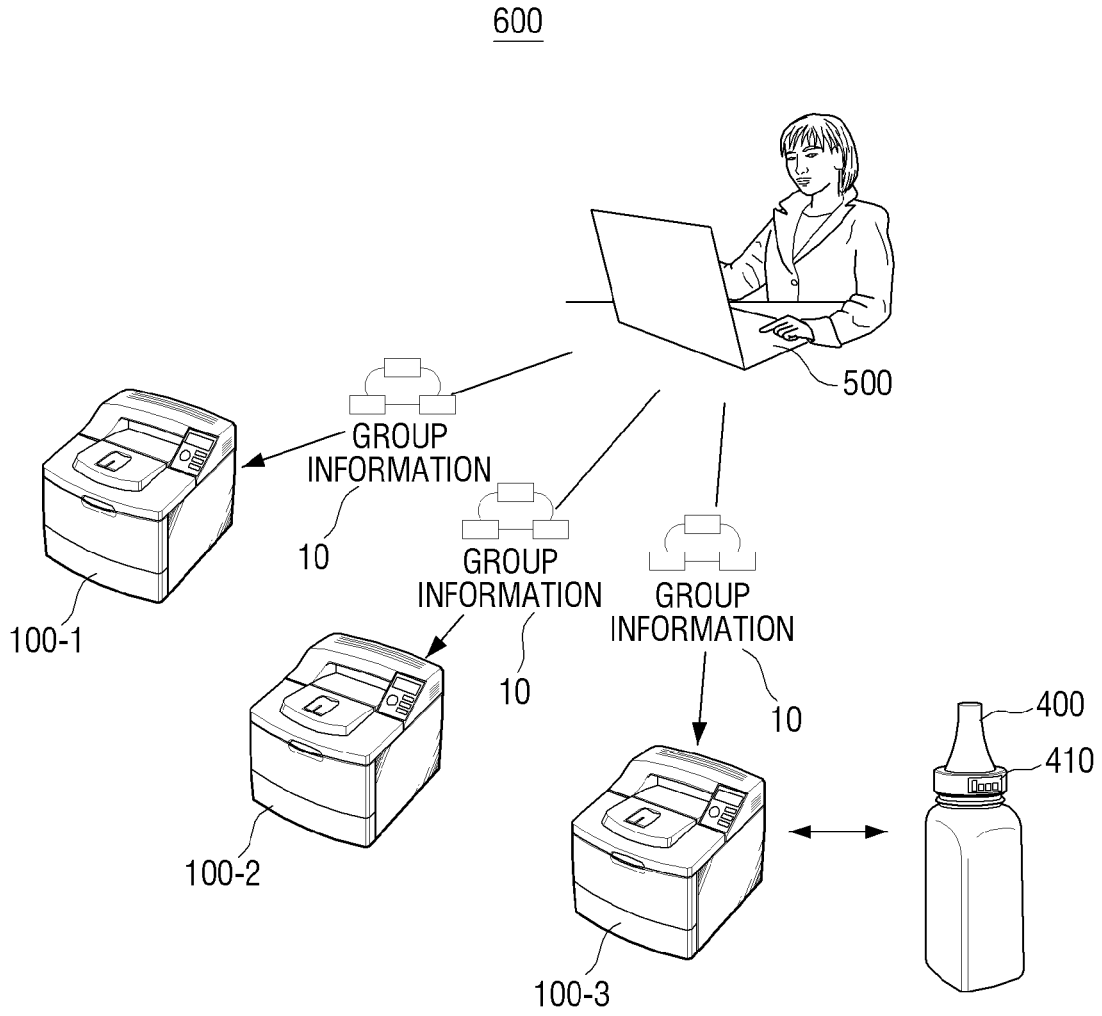
[Fig. 2]
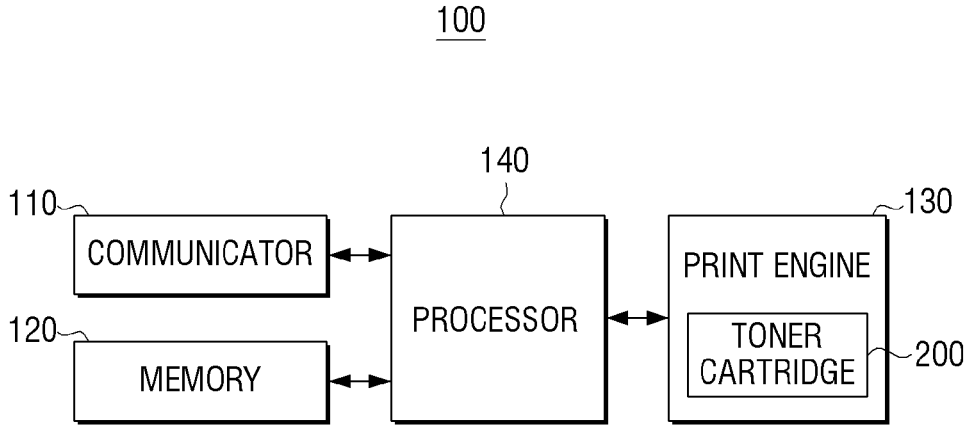

[Fig. 3]
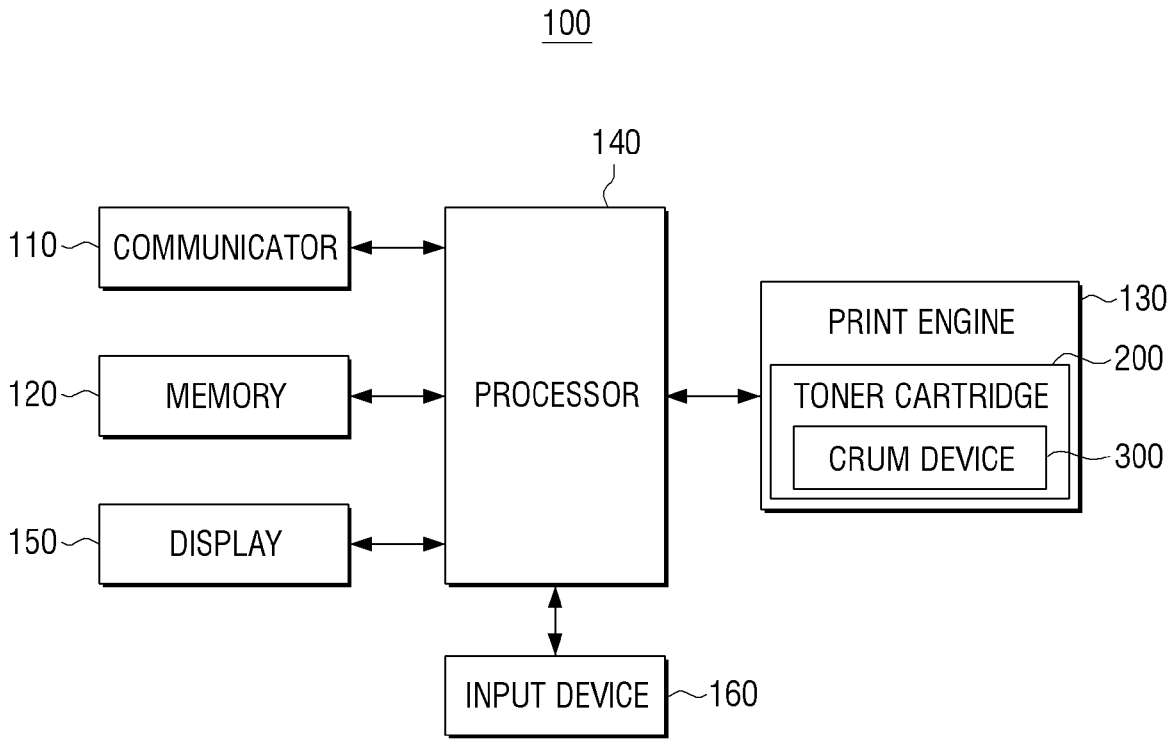
[Fig. 4]
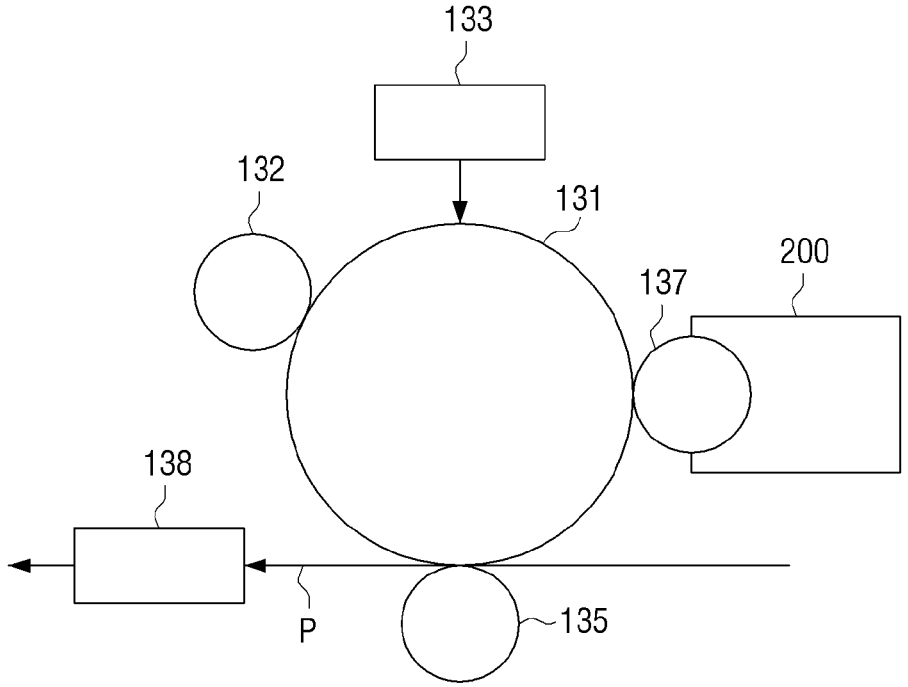

[Fig. 5]
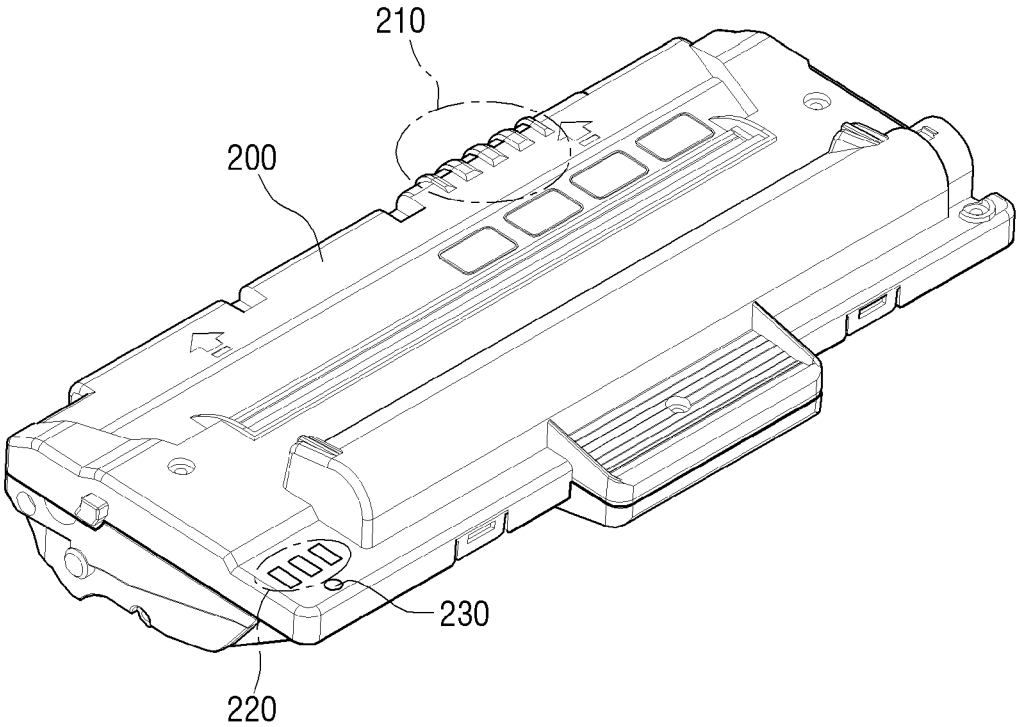
[Fig. 6]
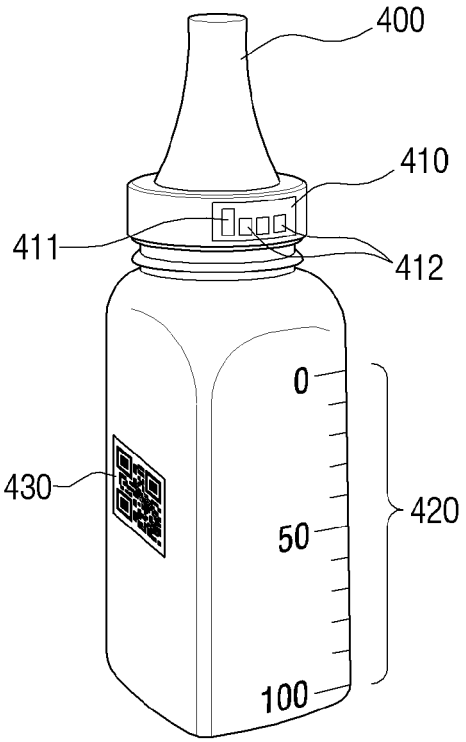

[Fig. 7]
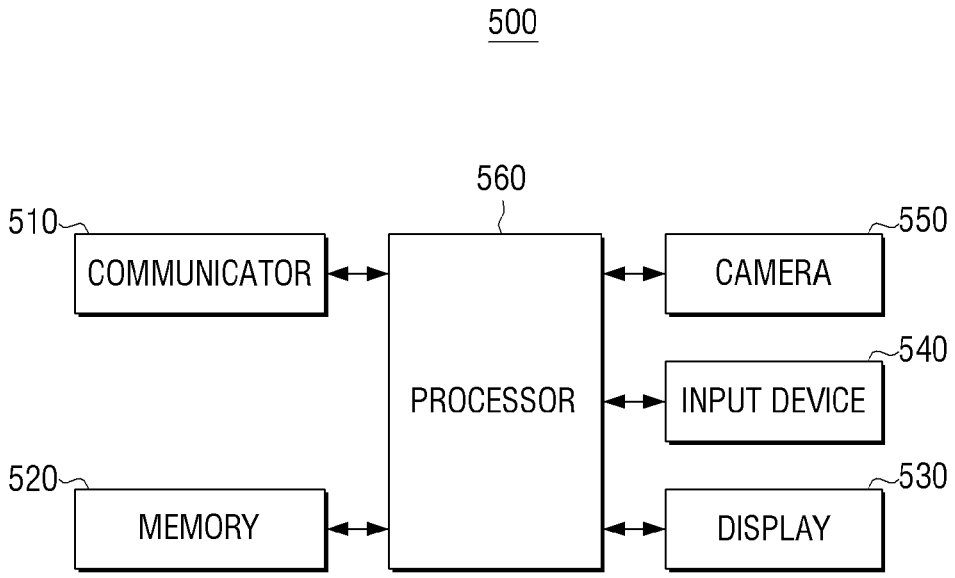
[Fig. 8]
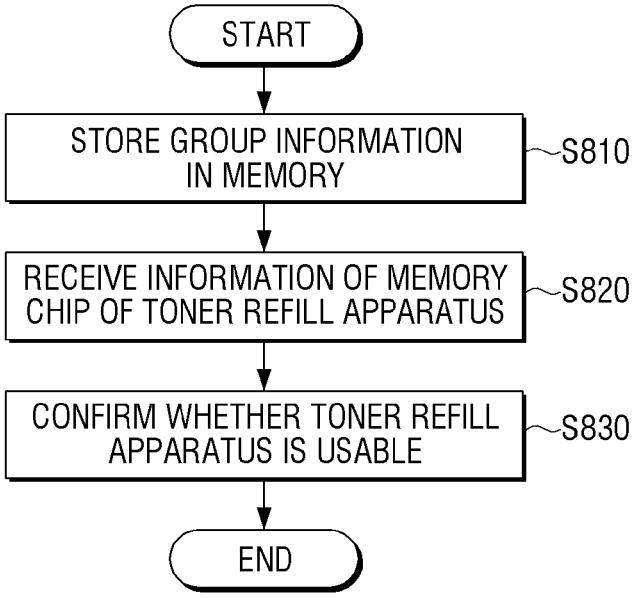

[Fig. 9]
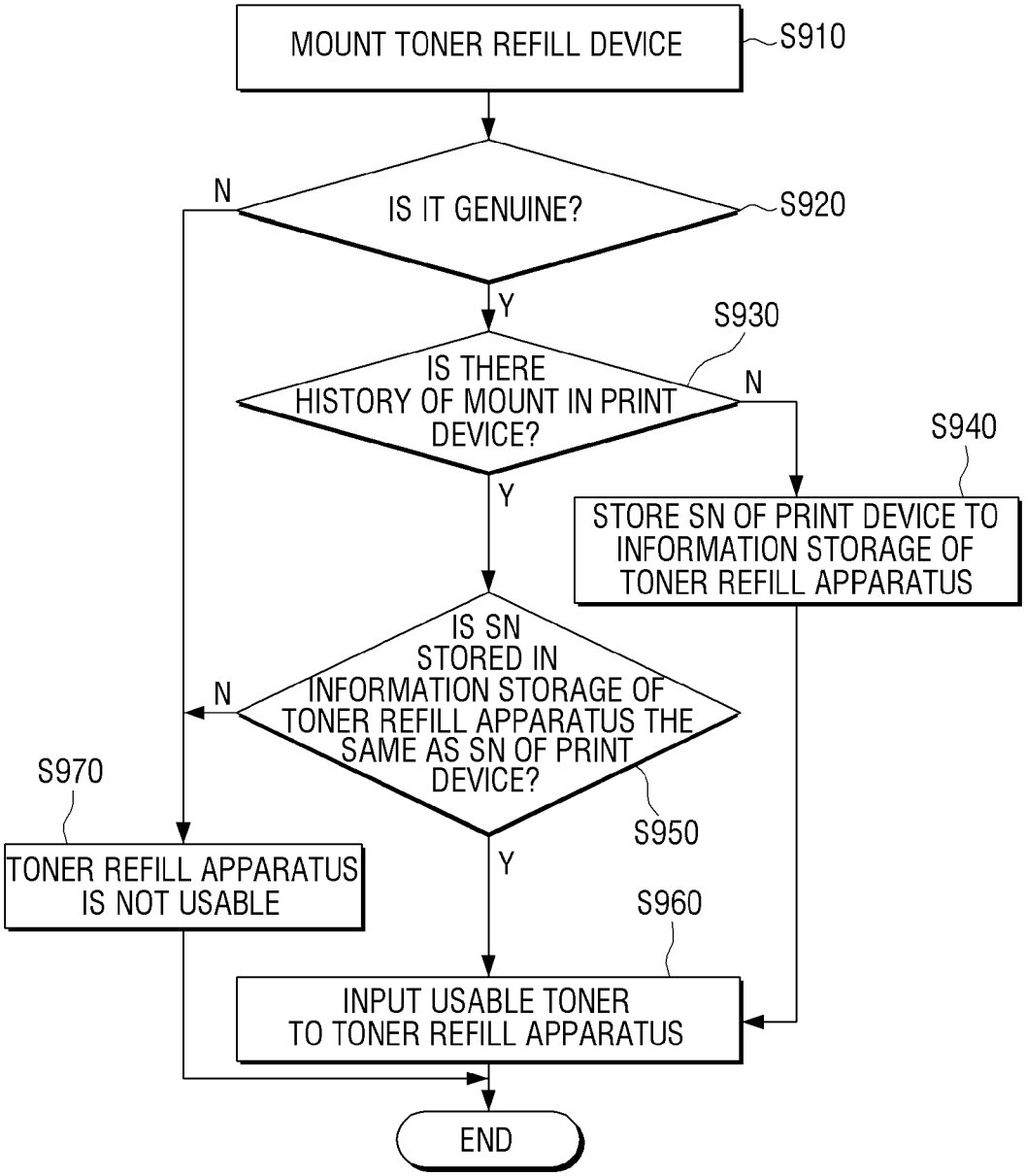

[Fig. 10]
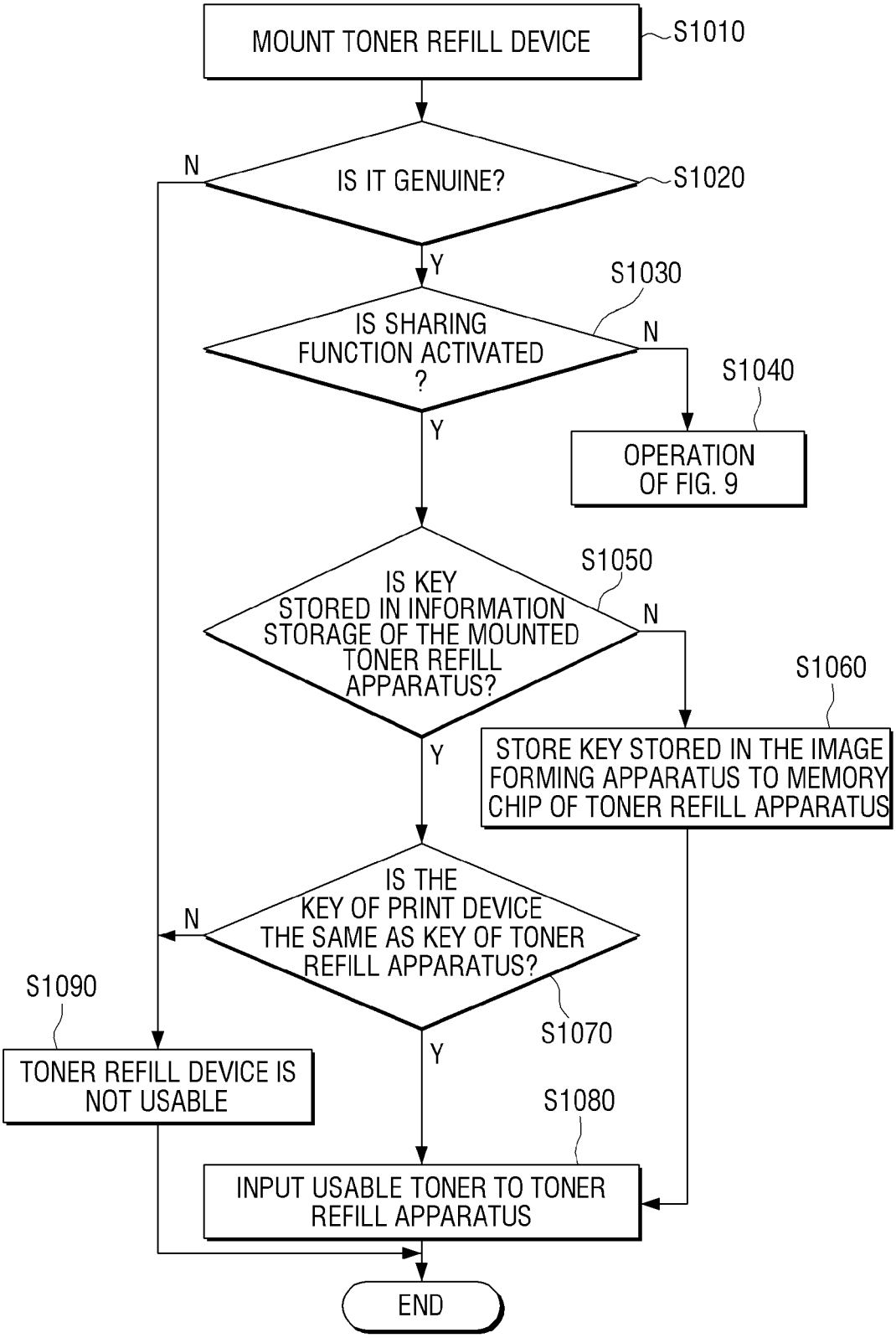

[Fig. 11]
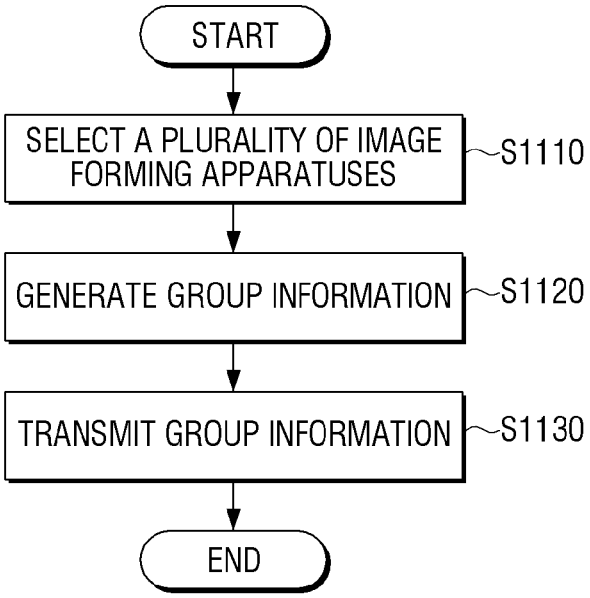

TONER REFILL CONTROL USING REUSABLE REFILL APPARATUS

BACKGROUND ART

An image forming apparatus refers to a device that prints print data generated by a terminal device such as a computer on a print paper. Examples of such an image forming apparatus include a copier, a printer, a scanner, a facsimile, or a multi-function peripheral (MFP) that combines the functions thereof.

An image forming apparatus using a laser printing method uses toner to print an image. The toner is used every time the image forming operation proceeds, and is exhausted when it is used for a predetermined time or more.

DISCLOSURE OF INVENTION

Brief Description of Drawings

The above and/or other aspects of the present disclosure will be more apparent by describing certain examples of the present disclosure with reference to the accompanying drawings, in which:

FIG. 1 is a view illustrating a configuration of an image forming system according to an example, FIG. 2 is a block diagram illustrating a simple configuration of an image forming apparatus, such as the image forming apparatus of FIG. 1, according to an example, FIG. 3 is a block diagram illustrating a configuration of an image forming apparatus, such as the image forming apparatus of FIG. 1, according to an example, FIG. 4 is a view illustrating a configuration of a print engine, such as the print engine of FIG. 2, according to an example, FIG. 5 is a view illustrating a shape of a toner cartridge, such as the toner cartridge of FIG. 2, according to an example, FIG. 6 is a view illustrating a toner refill apparatus according to an example, FIG. 7 is a block diagram illustrating a configuration of an electronic device, such as the electronic device of FIG. 1, according to an example, FIG. 8 is a flowchart to describe a communication method of an image forming apparatus according to an example, FIG. 9 is a flowchart to describe a toner refill operation according to an example, FIG. 10 is a flowchart to describe a toner refill operation according to an example, and FIG. 11 is a flowchart to describe a communication method of an electronic device according to an example.

Throughout the drawings, it should be noted that like reference numbers are used to depict the same or similar elements, features, parts, components, and structures.

MODE FOR THE INVENTION

Hereinafter, various examples will be described below with reference to the drawings. The examples described below may be modified and implemented in various different forms. In order to more clearly describe the features of the examples, a detailed description of known matters to those skilled in the art will be omitted.

In the present specification, when an element is referred to as being "connected" with another element, it includes not only a case of being directly connected, but also a case of being connected with another element in between. Also, when an element is referred to as "including" another element, it means that the element may not exclude another element but may further include other elements, unless specifically stated otherwise.

In the present specification, the term "image forming job" may mean various jobs (e.g., copying, printing, scanning, or faxing) related to an image, such as forming the image or generating/storing/transmitting an image file, and the term "job" may mean not only the image forming job but also a series of processes necessary for performing the image forming job.

Also, the term "image forming apparatus" refers to an apparatus that prints print data generated by a terminal apparatus such as a computer on a recording paper. Examples of such an image forming apparatus include a copier, a printer, a scanner, a facsimile, or a multi-function printer (MFP) that combines functions thereof through a single apparatus. The image forming apparatus may mean any apparatus capable of performing the image forming job, such as the copier, the printer, the scanner, a fax machine, the MFP, or a display apparatus.

Also, the term "print data" may mean data converted into a printable format by the printer. Meanwhile, when the printer supports direct printing, the file itself may be print data.

Also, the term "user" may mean a person who performs an operation related to the image forming operation using an image forming apparatus or a device connected with the image forming apparatus by a wired or wireless connection. The term "manager" may mean a person who has authority to access all functions and systems of the image forming apparatus. The "manager" and the "user" may be the same person.

FIG. 1 is a view illustrating a configuration of an image forming system according to an example.

Referring to FIG. 1, an image forming system 600 may include a plurality of image forming apparatuses 100-1, 100-2, and 100-3, a toner refill apparatus 400, and an electronic apparatus 500.

Each of the plurality of image forming apparatuses 100-1, 100-2, and 100-3 may perform an image forming job such as a printing job using a toner cartridge.

Each of the plurality of image forming apparatuses 100-1, 100-2, and 100-3 receives group information 10 for sharing the toner refill apparatus 400 from the electronic apparatus 500, and checks the availability of the toner refill apparatus 400 based on the stored group information 10.

Each of the plurality of image forming apparatuses 100-1, 100-2, and 100-3 may be refilled with toner through the toner refill apparatus 400 which is determined to be usable. An example configuration and operation of an image forming apparatus 100 will be described later with reference to FIGS. 2 and 3.

The toner refill apparatus 400 is connected to any one of the plurality of image forming apparatuses 100-1, 100-2, and 100-3 to provide toner. In FIG. 1, an example is illustrated in which the toner refill apparatus 400 is connected to the image forming apparatus 100-3 to refill the toner of the image forming apparatus 100-3 (more specifically, the toner cartridge of the image forming apparatus).

The toner refill apparatus 400 includes a memory chip 410 that stores device information of the toner refill apparatus 400. Here, the device information may include inherent information of the toner refill apparatus 400 and may include serial number information, manufacturer information, manufacturing date, and the like of the toner refill apparatus 400.

When the toner refill apparatus 400 is connected to the image forming apparatus 100-3, use history information may be stored by the image forming apparatus 100-3. Here, the use history information is information for identifying whether the toner refill apparatus 400 has a history of being connected to the image forming apparatus 100-3, and may include identification information (e.g., serial number information) of the image forming apparatus 100-3 or serial number information of the toner cartridge, group information 10, or the like.

The group information 10 may include a code value generated by the electronic device 500 to use the toner refill apparatus 400 in a plurality of image forming apparatuses, and may be a random value or a value arbitrarily assigned by the administrator. This group information 10 may be a code for specifying a specific image forming apparatus, and may be referred to as an activation key, a shared key, or the like.

Such a toner refill apparatus 400 may be referred to as a refill bottle, a toner refill syringe, or the like and the memory chip 410 may be referred to as a refill bottle memory, a refill bottle chip, or the like. An example configuration and operation of the toner refill apparatus 400 will be described later with reference to FIG. 6.

The electronic device 500 selects an image forming apparatus to which the toner refill apparatus 400 is to be shared, and generates group information 10 to be commonly used by the selected image forming apparatus. The electronic device 500 may transmit the group information 10 to the selected image forming apparatuses 100-1, 100-2, and/or 100-3. An example configuration and operation of the electronic device 500 will be described later with reference to FIG. 7.

As described above, in the image forming system 600 according to the an example, since the group information is shared by a plurality of image forming apparatuses, it is possible to use the toner refill apparatus shared by the plurality of image forming apparatuses.

In describing FIG. 1, it is described that the electronic device 500 is directly connected to the plurality of image forming apparatuses 100-1, 100-2, and 100-3. However, connection may be made through another device such as a router.

In describing FIG. 1, the group information 10 is directly transferred from the electronic device 500 to the plurality of image forming apparatuses 100-1, 100-2, and 100-3. However, in implementation, the group information 10 may be transferred through a storage medium such as a universal serial bus (USB) memory to the image forming apparatus and an administrator may directly input the group information 10 into each of the plurality of image forming apparatuses 100-1, 100-2, and 100-3.

FIG. 2 is a block diagram illustrating a simple configuration of an image forming apparatus, such as the image forming apparatus of FIG. 1, according to an example.

Referring to FIG. 2, the image forming apparatus 100 may include a communicator 110, a memory 120, a print engine 130, and a processor 140.

The communicator 110 may connect the image forming apparatus 100 to an external device and may be connected to a terminal device via a local area network (LAN) or an Internet network. It may be connected using a USB port or a wireless communication (e.g., WiFi 802.11a/b/g/n, NFC, Bluetooth, etc.) port. The communicator 110 may be referred to as a transceiver.

The communicator 110 receives the group information 10 from the electronic device 500. In implementation, it is possible to receive the group information 10 using a USB memory device or using a wireless method.

The communicator 110 may communicate with the memory chip 410 attached to the toner refill apparatus 400. For example, the communicator 110 may perform communication with the memory chip 410 of the toner refill apparatus 400 when the toner refill apparatus 400 is connected to a toner cartridge 200 (or a developer).

The communicator 110 may be electrically connected to the toner refill apparatus 400 through a plurality of terminals mounted on the toner cartridge 200 or may communicate with the memory chip 410 of the toner refill apparatus 400 using an RFID method.

If it is determined that the amount of toner in the toner cartridge 200 is less than a predetermined amount and the toner cartridge 200 needs to be replaced or the toner refill needs to be performed, the communicator 110 may transmit information about the toner cartridge 200 to the electronic device 500 or a management server (not shown).

The communicator 110 may receive information on the refilled toner amount through the electronic device 500.

The memory 120 may store history information of a print job performed in the image forming apparatus 100. The memory 120 may store information on the toner refill history for the toner cartridge 200. Also, the memory 120 may store information indicating that a refill is in progress if the toner refilling is in progress. Such information may be deleted when the toner refill is completed.

The memory 120 may store the group information 10 provided from the electronic device 500. Such group information 10 may not be stored in the memory 120 inside the image forming apparatus 100 but may be stored in a customer replaceable unit monitor (CRUM) device, such as a CRUM device 300 that will be described below with reference to FIG. 3.

The memory 120 may be implemented as a storage medium in the image forming apparatus 100 or as an external storage medium such as a removable disk including a USB memory, a web server using a network, or the like. The memory 120 may be composed of a plurality of memory elements. As an example, the memory 120 may be constituted as a first memory for storing data necessary for performing an operation of an image forming apparatus, and a second memory for storing information related to the CRUM device (e.g., CRUM device 300) or the toner refill apparatus 400. Here, the second memory may be a non-transitory memory such as an Electrically Erasable Programmable Read-Only Memory (EEPROM).

The print engine 130 forms an image. An example configuration and operation of the print engine 130 will be described with reference to FIG. 4.

The processor 140 controls operations in the image forming apparatus 100. The processor 140 may be constituted by a single device such as a central processing unit (CPU), and may be implemented as a plurality of devices such as a clock generating circuit, a CPU, and a graphic processor.

The processor 140 stores the group information 10 in the memory 120 when the group information 10 is input. As an example, when the processor 140 receives the group information 10 from the electronic device 500 or receives the group information 10 through an input device, the processor 140 may store the received or inputted group information 10 in the memory 120.

The processor 140 may activate a sharing function for the toner refill apparatus 400 when the group information 10 is stored. For example, if the sharing function for the toner refill apparatus 400 is not activated, the processor 140 may not determine whether the group information 10 is stored when the toner refill apparatus 400 is connected. Conversely, when the sharing function of the toner refill apparatus is activated, the processor 140 may not perform an operation to determine whether the group information 10 is stored when the toner refill apparatus 400 is connected, and store the group information 10.

In addition, the processor 140 may perform communication with the memory chip 410 of the toner refill apparatus 400. If the toner refill apparatus 400 and the image forming apparatus 100 are connected by a wired connection, the processor 140 may perform communication with the memory chip 410 of the toner refill apparatus 400 by using an inter-integrated circuit (I2C) method or an enhanced I2C (eI2C) method.

When a user connects the toner refill apparatus 400 to the image forming apparatus 100, the processor 140 may determine whether the toner refill apparatus 400 is connected to the image forming apparatus 100 (more specifically, the toner cartridge 200). For example, when the processor 140 confirms an electrical connection with the memory chip 410 of the toner refill apparatus 400, it may be determined that the toner refill apparatus 400 is connected.

When the toner refill apparatus 400 is connected, the processor 140 may determine the availability of the toner refill apparatus 400 based on the information stored in the memory chip 410 of the toner refill apparatus 400. For example, the processor 140 may read the information stored in the memory chip 410 and may perform an authentication procedure based on the information stored in the memory chip 410 to determine whether the connected toner refill apparatus 400 is a legitimate device.

The authentication procedure may be the same as or similar to an authentication method for the CRUM device 300 that will be described later with reference to FIG. 3. Alternatively, authentication of the toner refill apparatus 400 may be performed in a manner different from the authentication method for the CRUM device 300. For example, the authentication procedure for the toner refill apparatus 400 may be performed in a simpler manner than the authentication method for the CRUM device 300 by using a relatively low security strength encryption algorithm or using a relatively simple authentication process. For example, the processor 140 may perform an authentication procedure to decrypt the digital signature stored in the memory chip 410 of the toner refill apparatus 400.

If the toner refill apparatus 400 is an authenticated device, the processor 140 may determine whether or not the toner refill apparatus 400 is available. More specifically, the processor 140 may determine to proceed with refilling toner using the information stored in the currently-connected toner refill apparatus 400, if information related to another image forming apparatus and the group information 10 are not stored in the memory chip 410.

Here, the information related to the image forming apparatus may be the use history information indicating whether the toner refill apparatus 400 has been connected to the image forming apparatus 100 and may include serial number information (for example, serial number information of an image forming apparatus or serial number information of a toner cartridge). In implementation, information related to the image forming apparatus 100 such as MAC information of an image forming apparatus or information which may specify a toner cartridge may be used.

Accordingly, when the use history information is not recorded in the memory chip 410, the processor 140 may determine that the toner refill apparatus 400 does not have use history and is usable.

If an error occurs in the toner refilling process, for example, when the power of the image forming apparatus 100 is turned off during the refilling process, and if only a part of the toner is mistakenly refilled by the user, a method for using the toner refill apparatus 400 again is required.

Accordingly, even if information relating to the image forming apparatus 100 is stored, if the stored information is consistent with the information of the image forming apparatus 100, that is, the serial number information stored in the memory chip 410 is consistent with the serial number information of the image forming apparatus 100, the processor 140 may determine that the toner refill apparatus 400 is usable.

For this operation, if the memory chip 410 does not record information relating to other image forming apparatuses, that is, if the toner refill apparatus 400 is connected for the first time, information (for example, the serial number information of the image forming apparatus, the serial number information of the toner cartridge) of the image forming apparatus 100 may be stored in the memory chip 410.

An administrator may want to use the toner refill apparatus 400 in a plurality of image forming apparatuses depending on the use environment. In this case, the administrator may generate the group information 10 and store it in each image forming apparatus.

Accordingly, when the sharing function for the toner refill apparatus 400 is set, that is, when the image forming apparatus 100 stores the group information 10, the processor 140 may store the group information 10 stored in the memory 120 in the memory chip 410 of the toner refill apparatus 400. Accordingly, the other image forming apparatuses sharing the group information 10 may use the toner refilling apparatus 400 together.

Thus, even if information relating to another image forming apparatus is recorded in the memory chip 410, if the group information 10 stored in the memory chip 410 and the group information 10 stored in the memory 120 are the same, the processor 140 may determine that the toner refill apparatus 400 is usable.

When the processor 140 determines that the toner refill apparatus 400 is usable, a control command that a locking member of the toner cartridge 200 is moved in the direction of a hole so that the toner of the toner refill apparatus 400 may be injected into the toner cartridge 200 may be transmitted to the toner cartridge 200.

When the toner refilling process is being performed, the processor 140 may store information in the memory 120 that the toner refilling is being performed. When the toner refilling is completed, the processor 140 may remove the information indicating that the toner refilling is being performed from the memory 120. Accordingly, the processor 140 may determine that the information indicating that the toner refilling process is being performed during the initial booting of the image forming apparatus 100 is stored in the memory 120, an error has occurred during the toner refilling process, and inform a user that the toner refilling should be re-performed.

When the toner refilling is performed, the processor 140 may determine whether the toner refilling is completed. For example, the processor 140 may determine that the toner injection is completed when the amount of toner detected in the toner cartridge is changed to a predetermined value or more by using a sensor that detects the amount of toner in the toner cartridge 200. In an example, the processor 140 may continuously determine whether the toner refilling is completed.

The processor 140 may determine whether the toner refill apparatus 400 is separated from the toner cartridge 200 based on the electrical connection state between the toner refill apparatus 400 and the toner cartridge 200 to determine whether the toner refill is completed. In such a case, the processor 140 may perform additional confirmation as to whether the toner refilling is completed based on the amount of toner in the toner cartridge 200 as described above.

When the toner refilling is completed, the processor 140 may newly update the toner amount of the toner cartridge 200. For example, the processor 140 may use the sensor provided in the toner cartridge 200 to change the newly detected amount of toner to the amount of toner in the corresponding toner cartridge.

In the foregoing example, a configuration which constitutes the image forming apparatus has been described, but in implementation, various configurations may be additionally provided.

FIG. 3 is a block diagram illustrating a configuration of an image forming apparatus, such as the image forming apparatus of FIG. 1, according to an example.

Referring to FIG. 3, the image forming apparatus 100 may include the communicator 110, the memory 120, the print engine 130, the processor 140, a display 150, and an input device 160.

The communicator 110 and the memory 120 have been described with reference to FIG. 2, and redundant description will be omitted. Similarly, the print engine 130 and the processor 140 have been described with reference to FIG. 2. However, the contents described in FIG. 2 are not duplicated and only the contents related to the configuration added in FIG. 3 will be described below.

The processor 140 may communicate with the CRUM device 300. For example, the processor 140 may perform communication for the authentication of the CRUM device 300 and for data management stored in the CRUM device 300.

Here, the processor 140 may perform communication with the CRUM device 300 using the I2C method or the eI2C method. Here, the CRUM device 300 is an apparatus for storing device information and the like of a consumable device (for example, the toner cartridge 200), and may be referred to as a memory, a memory chip, a chip device, a toner cartridge memory, and the like. The eI2C is a clock signal modified to have periodicity in the idle period in order to reliably output power from the clock signal. The eI2C may be referred to with various names such as a three-contact I2C scheme, an encoding I2C scheme, and the like.

The processor 140 may perform encryption for data which is transmitted between the CRUM device 300 and the memory chip 410 of the toner refill apparatus 400 and perform communication.

The processor 140 may perform an authentication procedure for determining whether the installed CRUM device 300 is a legitimate device based on the information provided by the CRUM device 300. In addition, the processor 140 may determine whether toner refilling is necessary based on the information (for example, information on a remaining amount of a consumable) provided in the CRUM device 300.

If toner refill is deemed necessary, the processor 140 may control the display 150 to display a message (for example, "toner refill is necessary") indicating that toner refill is required.

When cartridge information in the image forming apparatus 100 is used instead of the serial number information of the image forming apparatus 100, the cartridge information may be stored in the CRUM device 300 attached to the toner cartridge apparatus 200, and may be stored in the memory 120 of the image forming apparatus 100. Accordingly, when the cartridge information is stored in the memory chip 410 and the cartridge information is stored in the CRUM device 300, the processor 140 may read the cartridge information stored in the CRUM device 300.

The processor 140 may store the device information of the toner refill apparatus 400 in the CRUM device 300. Here, the information stored in the CRUM device 300 may be information unique to the toner refill apparatus 400 (for example, the serial number of the toner refill apparatus).

If it is determined that the toner refill apparatus 400 cannot be used, the processor 140 may control the display 150 to display a message indicating that the toner refill apparatus 400 cannot be used. Here, the message may indicate not only the inability of using the toner refill apparatus 400, but also a reason thereof. For example, the message may include information about whether a non-genuine toner refill apparatus is connected, whether the product has already completed the toner refill, and the like.

The processor 140, if an error occurs in the toner refill process, may control the display 150 to display a message that toner refill needs to be re-performed.

If the toner refill apparatus 400 is separated from the toner cartridge 200, but the increased toner amount is not equal to or more than a predetermined amount, the processor 140 may control the display 150 to display a message that the toner refill apparatus 400 should be connected again to provide additional toner.

In addition, the processor 140, if toner refill is completed, may control the display 150 to display a message to request that the toner refill apparatus 400 be separated from the image forming apparatus 100.

The processor 140, if an injection amount is input through the input device 160, or an injection amount is received through the electronic device 500, may change the amount of toner of the toner cartridge 200 based on the input or received injection amount. For this operation, the processor 140 may control the display 150 to display a message to input a toner injection amount at the time when toner refill is completed.

In this case, the processor 140 may store the newly changed amount of toner in the CRUM device 300 of the toner cartridge 200. In addition, the processor 140 may store the device information of the connected toner refill apparatus 400 in the CRUM device 300. In addition, information such as the number of toner refilling times may also be stored in the CRUM device 300.

The display 150 displays various information provided by the image forming apparatus 100. For example, the display 150 may display a user interface window for receiving various functions provided by the image forming apparatus 100.

The display 150 displays information on consumables. For example, if the display 150 determines that replacement of a consumable is necessary, the display may display the replacement information and display the predicted replacement timing.

In addition, when the toner in the toner cartridge 200 becomes a predetermined amount or less, the display 150 may display information indicating that the toner needs to be refilled (for example, a message indicating that replacement is necessary and information on a remaining amount of consumables).

The display 150 may display information that the authenticity of the connected toner refill apparatus 400 is not determined unless the authenticity of the connected toner refill apparatus 400 is confirmed. Here, the display 150 may also display information such as web page information for addressing a problem, a setting state of sharing of the toner refill apparatus, group information, usage history of the toner refill apparatus, an amount of toner in the present toner cartridge, a toner refill operation, and so on.

The display 150 may display manual information on the usage method of the toner refill apparatus 400 and may display a message notifying the user that the connected toner refill apparatus 400 cannot be used.

The display 150 may display a user interface (UI) window for receiving a toner injection amount. For example, the UI window may include an area for inputting the amount of injected toner when the toner refilling operation is completed, or an area for displaying the amount of injection according to a user's operation and an area for receiving the amount of injection. The area to which the injection amount is input may have a form of receiving a slide form or a form to receive a direct numerical value.

The input device 160 may receive from a user a command to select a function and a control command for the function. Here, the function may include a printing function, a copying function, a scanning function, a fax transmission function, and so on. The function control command may be received through a control command displayed on the display 150.

The input device 160 may receive the injected toner amount from the user.

The print engine 130 may perform a printing job using toner filled in the toner cartridge 200.

The toner cartridge 200 is a device to provide toner to a developer, and toner may be refilled in the toner cartridge 200 by the toner refill apparatus 400. In the toner cartridge 200, the CRUM device 300 for storing information on the toner cartridge may be mounted. The CRUM device 300 may be attached to the toner cartridge 200 or separately mounted to the image forming apparatus 100.

An example configuration and operation of the toner cartridge 200 will be described later with reference to FIG. 5.

As described above, the image forming apparatus 100 according to the present example may refill and use the toner without replacing the toner cartridge 200. In addition, even when an error in the refilling process occurs, it is possible to reuse the toner refill apparatus 400 when the same is used again in the same image forming apparatus 100. Further, the image forming apparatus 100 according to the present example uses the group information 10, and a plurality of image forming apparatuses may share one toner refill apparatus 400. Further, the image forming apparatus 100 may determine a more accurate toner injection amount by receiving the toner injection amount from the user.

In describing FIGS. 2 and 3, it has been described that the image forming apparatus 100 includes one toner cartridge. However, the image forming apparatus 100 may be provided with a plurality of toner cartridges in implementation. In addition, a plurality of CRUM devices may be mounted in the image forming apparatus corresponding thereto.

In describing FIGS. 2 and 3, it has been described that the processor 140 directly communicates with the CRUM device 300 and the toner refill apparatus 400. However, in implementation, the processor 140 may communicate with the CRUM device 300 or the memory chip 410 of the toner refill apparatus 400 through the communicator 110.

FIG. 4 is a view illustrating a configuration of a print engine, such as the print engine of FIG. 2, according to an example.

Referring to FIG. 4, the print engine may include a photosensitive drum 131, a charger 132, a laser scanning device 133, a developer 200, a transfer device 135, and a fixing device 138.

The photosensitive drum 131 is formed with an electrostatic latent image. The photosensitive drum 131 may be referred to as a photosensitive drum, a photosensitive belt, and so on depending on a form.

The charger 132 charges the surface of the photosensitive drum 131 to a uniform potential. The charger 132 may be implemented in the form of a corona charger, a charging roller, a charging brush, or the like.

The laser scanning device 133 changes the surface potential of the photosensitive drum 131 according to the image information to be printed, thereby forming an electrostatic latent image on the surface of the photosensitive drum 131.

The developer 200 accommodates a developing agent therein, and supplies the developing agent to the electrostatic latent image to develop the electrostatic latent image into a visible image. The developer 200 may include a developing roller 137 for supplying the developing agent to the electrostatic latent image. For example, the developing agent may be supplied from the developing roller 137 to the electrostatic latent image formed on the photosensitive drum 131 by a developing electric field formed between the developing roller 137 and the photosensitive drum 131. The implementation of the developer 200 that is replaceable is referred to as a toner cartridge. An example configuration and operation of the toner cartridge 200 will be described later with reference to FIG. 5.

The visible image formed on the photosensitive drum 131 is transferred to a recordable medium (P) by the transfer device 135 or an intermediate transfer belt (not shown).

The fixing device 138 fixes the visible image on the recording medium P by applying heat and/or pressure to the visible image on the recording medium P. The printing operation is completed by this series of processes.

FIG. 5 is a view illustrating a shape of a toner cartridge, such as the toner cartridge of FIG. 2, according to an example.

Referring to FIG. 5, the toner cartridge 200 includes toner therein. The toner cartridge 200 includes first terminals 210 to be electrically connected to the image forming apparatus 100, second terminals 220 to be electrically connected to the toner refill apparatus 400, and a hole 230 for receiving refill of toner.

The first terminals 210 may be electrically connected to terminals inside the image forming apparatus 100 when the toner cartridge 200 is mounted on the image forming apparatus 100. Here, the first terminals 210 may transceive a signal for communication between the image forming apparatus 100 and the toner cartridge 200 but also a signal for communicating with the CRUM device 300 attached to the toner cartridge 200 or the toner refill apparatus 400.

The second terminals 220 may be electrically connected to the terminals of the memory chip 410 of the toner refill apparatus 400 when the toner refill apparatus 400 is connected to the hole for refilling. Here, the second terminals 220 may transmit and receive signals between the image forming apparatus 100 and the memory chip 410.

The hole 230 is a hole for receiving toner from the toner refill apparatus 400. A locking member (not shown) for electrically opening and closing the hole may be disposed at an upper portion of the hole 230 or an intermediate position of the hole. Here, the locking member (not shown) is a device for opening and closing the hole 230 according to an electrical signal, and may be driven by a device such as a solenoid.

Accordingly, the toner cartridge 200, only when the use of the toner refill apparatus 400 is confirmed, may receive toner of the toner refill apparatus 400 selectively.

In addition, the toner cartridge 200 may include a sensor (not shown) for detecting the amount of toner therein. In addition to determining the amount of toner in the toner cartridge using such a sensor (not shown), it is also possible to determine whether the toner is normally injected through the toner refilling process.

In describing FIG. 5, it is shown and described that the toner cartridge 200 includes second terminals 220 for performing communication with the memory chip 410 of the toner refill apparatus. However, when the communication between the toner refill apparatus 400 and the image forming apparatus 100 is performed in a wireless manner such as RFID, the above-described second terminals 220 may be omitted.

FIG. 6 is a view illustrating a toner refill apparatus according to an example.

Referring to FIG. 6, the toner refill apparatus 400 may include the memory chip 410, a bottle 420 having markings to determine toner amount, and a quick response (QR) code 430.

The bottle 420 has a bottle shape capable of holding toner, and an upper portion of the bottle 420 may have an outlet through which toner may be injected into the hole 230 of the toner cartridge 200. In addition, on one side of the body of the bottle 420, there is a scale for determining the amount of toner filled in the toner refill apparatus 400.

The memory chip 410 stores device information of the toner refill apparatus 400 and may be disposed on one side of the toner refill apparatus 400. For example, the memory chip 410 may be disposed at a position where it may be connected to the second terminals 220 when an inlet of the toner refill apparatus 400 contacts the hole 230 of the toner cartridge. In the illustrated example, it is described that the memory chip 410 is disposed on the side of the bottle, but may also be disposed in the inlet.

The memory chip 410 is a memory chip for storing the device information of the toner refill apparatus 400 and may be composed of a memory 411 and a plurality of terminals 412.

The memory 411 may store device information of the toner refill apparatus 400. For example, information such as serial number information, manufacturer, manufacture date, information on included toner, and the like of the toner refill apparatus 400 may be stored. The memory 411 may also store usage history information related to toner refills. For example, the usage history information may be identification information of a first connected image forming apparatus indicating that there is a refill history, cartridge information of an image forming apparatus initially connected, group information stored in an image forming apparatus initially connected, and the like.

Information related to the history information such as the start information and the end information may be recorded by the processor 140 when the memory 411 is electrically connected to the image forming apparatus 100. Further, when the image forming apparatus 100 stores the group information 10, the memory 411 may also store the group information 10 by the processor 140.

The memory 411 may be non-transitory memory such as electrically erasable programmable read-only memory (EEPROM).

The information stored in the memory 411 may be encoded and stored.

The plurality of terminals 412 may electrically connect the memory 411 and the processor 140 of the image forming apparatus.

The QR code 430 has a uniform resource locator (URL) address for confirming the information of the toner refill apparatus 400. When the user reads the QR code 430 using a terminal device such as a mobile device, a webpage providing a manual or other information for a method of using a toner cartridge or a download site to download an application for supporting the aforementioned operation may be connected.

FIG. 7 is a block diagram illustrating a configuration of an electronic device, such as the electronic device of FIG. 1, according to an example.

Referring to FIG. 7, the electronic device 500 may be comprised of a communicator 510, a memory 520, a display 530, an input device 540, a camera 550 and a processor 560. Such an electronic device 500 may be a smart phone as well as a device such as a personal computer (PC), a notebook, and a server.

The communicator 510 is connected to the image forming apparatus 100 through a local area network (LAN) or an Internet network, as well as a USB port or wireless communication (for example, WiFi 802.11a/b/g/n, NFC, Bluetooth, etc.) ports. The communicator 510 may be referred to as a transceiver.

The communicator 510 may receive the status information of the image forming apparatus 100 and may transmit the group information 10 to the image forming apparatus 100. Here, the status information may be the type of the image forming apparatus, the operation state of the image forming apparatus, the type of the toner cartridge, and the like.

The communicator 510 may transmit the toner amount which is received from a user or calculated from the processor 560 to be described later to the image forming apparatus 100.

Also, the communicator 510 may access a preset URL address to receive a user manual or receive an application related to the use of the toner refill apparatus 400. The predetermined URL address may be an address directly input by the user or an address corresponding to the QR code 430 attached to the toner refill apparatus 400.

The memory 520 stores a program for driving the electronic device 500. For example, the memory 520 may store a program, which is a set of various commands necessary for driving the electronic device 500. Here, the program may include an application program for utilizing the toner refill apparatus or an image forming apparatus, as well as an operating program for operating the application.

The memory 520 may store information on a connectable image forming apparatus, information on a group set by a user, the generated group information 10, and the like.

The display 530 may display a user interface window for receiving a function supported by the electronic device 500. For example, the display 530 may display a user interface window for selecting a function of the image forming apparatus 100 or receiving a document to be output from the image forming apparatus 100.

The display 530 may display a manual associated with the use of the toner refill apparatus 400. For example, the above-described user interface window may display a manual in a form including manual information in an image photographed by the camera 550. That is, an augmented reality method may be applied to display an image combining reality information and manual information.

The display 530 may display a user interface window for receiving the amount of toner injected by the user during the toner refilling process using the toner refill apparatus 400. For example, the above-described user interface window may include a gauge bar having a range from 0 to 100. In this case, the user may move the gauge bar and input the amount of the injected toner. The range from 0 to 100 may indicate a percentage of toner or an amount of toner in any of various units as applicable.

The display 530 may display a user interface window for selecting the image forming apparatus 100 to share the toner refill apparatus 400. For example, the user interface window may include an area for displaying information of a connectable image forming apparatus, and an area for displaying a device to be used together. Here, the area to be displayed may be displayed including only a device that may use the same toner. For example, if the connectable device is an A device, a B device, and a C device, and only the A device and the B device may use the same toner, the area for displaying the information may display only the A device and the B device.

If the type of the toner refill apparatus 400 to be used is selected from the user in advance, for example, in the case of using a toner refill apparatus 400 which is one of CMYK colors, only the image forming device capable of color printing may be displayed. Further, an area for displaying information at the time of implementation may display information of each image forming apparatus together. For example, information on the apparatus name, color print availability, toner remaining amount, and the like may be displayed.

The input device 540 receives a user control command for controlling functions of the electronic device 500. The input device 540 receives a command for performing a function of the connectable image forming apparatus.

The input device 540 may select a plurality of image forming apparatuses to share the toner refill apparatus 400. Further, the input device 540 may receive the amount of toner injected from the toner refill apparatus 400.

The camera 550 captures an image. For example, the camera 550 has an image pickup device such as a charge coupled device (CCD), a complementary metal oxide semiconductor (CMOS), or the like, and may generate an image of an image of a predetermined area. For example, the camera 550 may photograph the toner refill apparatus 400 before refilling the toner and the toner refill apparatus 400 after refilling the toner.

The processor 560 performs control for each configuration within the electronic device 500. For example, the processor 560 may control the display 530 to display connectable image forming apparatuses when the management application for the image forming apparatus is activated.

When an image forming apparatus 100 to be shared with the toner refill apparatus 400 is selected from among the image forming apparatuses displayed, the processor 560 may generate group information 10 commonly used by the selected image forming apparatus 100, and control the communicator 510 to transmit the generated group information 10 to the selected image forming apparatus 100.

Here, the processor 560 may generate a random value as the group information 10, or may generate the group information 10 using the device information of the electronic device 500. Alternatively, the processor 560 may generate the group information 10 using the device information of the electronic device 500, or generate the input value from a user or an administrator as device information.

In the above description, the user selects the image forming apparatus to commonly use the toner refill apparatus 400. However, in implementation, the processor 140 may use the toner refill apparatus 400 among the connectable image forming apparatuses. It is also possible to automatically select the image forming apparatus.

For example, if the toner refill apparatus 400 is the yellow toner of the manufacturer A, the manufacturer A's apparatus among the connectable image forming apparatuses is firstly selected, the apparatus having the color toner is secondarily selected, to select an image forming apparatus using the toner refill apparatus.

When the QR code 430 is captured through the camera 550, the processor 560 analyzes the QR code 430 to read out the URL address, and may control the communicator 510 to access the web page corresponding to the read URL address.

The processor 560 may control the display 530 to display information provided from the web page. For example, if the QR code 430 has a web page address that provides a manual for using the toner refill apparatus 400, the electronic device 500 may display a manual for using the toner refill apparatus in accordance with the connection of the QR code 430.

When the toner refilling process is performed, the processor 560 may control the display 530 to display a message asking the user to capture the toner refill apparatus 400 before refilling the toner. In addition, the processor 560 may control the display 530 to display a message requesting that the toner refill apparatus 400 completes supplying the toner when the toner refilling of the toner refill apparatus 400 is completed.

When the toner refill apparatus 400 before and after the toner refill is captured from the camera 550 in response to such a request, the processor 560 may determine the change in the amount of toner in the two captured images, and calculate the determined amount of change as the toner filling amount. For example, the processor 560 may recognize the toner refill apparatus 400 in two sensed images, recognize the scale corresponding to the amount of toner in the recognized toner refill apparatus 400, and determine the amount of toner before and after the toner refilling.

When the toner refilling process is completed, the processor 560 may control the display 530 to display a message requesting the user to input the toner injection amount, and use the toner input amount received from a user as the toner injection amount.

The processor 560 may control the communicator 510 to transmit the calculated amount of toner or the amount of toner input from the user to the image forming apparatus 100 to which the present toner refill apparatus 400 is connected.

As described above, the electronic device 500 according to the present example generates the group information 10 and provides the group information 10 to a plurality of image forming apparatuses that use the group information 10, so it is possible to share and use the toner refill apparatus 400 in the image forming apparatus.

The electronic device 500 according to the present example provides various information related to the method of using the toner refill apparatus, so that the user may easily perform the toner refilling operation. In addition, the electronic device 500 according to the present example calculates the amount of injected toner using the photographed image, or provides the amount of injection input from the user to the image forming apparatus 100, thus enabling to determine an injected toner amount more accurately.

In describing FIG. 7, it is described that the electronic device 500 performs both the group information generating function, the manual providing function, and the toner amount checking function. In implementation, however, the electronic device 500 may be implemented in a form that includes only some of the functions.

FIG. 8 is a flowchart to describe a communication method of an image forming apparatus according to an example.

Referring to FIG. 8, the group information 10 corresponding to a plurality of image forming apparatuses to share a toner refill apparatus 400 for refilling the toner in the toner cartridge 200 of the image forming apparatus 100 is stored in operation S810. For example, upon reception of the group information 10 from the electronic device 500, the received group information 10 may be stored. Alternatively, when the group information 10 is input through the input device 160, the input group information 10 may be stored in the memory 120. In implementation, the group information 10 may be stored in the CRUM device 300.

The information stored in the memory chip 410 attached to the toner refill apparatus 400 is received in operation S820. For example, when the toner refill apparatus 400 is connected to the toner cartridge 200 for toner refill, the memory chip 410 of the toner refill apparatus 400 and the image forming apparatus 100 are electrically connected. Here, the image forming apparatus 100 may receive the information stored in the memory chip 410. Here, if the information stored in the memory chip 410 is encrypted, the image forming apparatus 100 may decode the received information.

Whether or not the toner refill apparatus 400 may be used is determined based on the information stored in the memory chip 410 of the toner refill apparatus 400 and the group information 10 in operation S830. For example, when the memory chip 410 does not store the information of the other image forming apparatuses and the group information 10, or the information of the other image forming apparatuses is the same as the group information 10 currently stored in the image forming apparatus, or if the group information 10 which is the same as the group information 10 stored in the current image forming apparatus is stored in the memory chip 410, it may be determined that the device is usable.

Therefore, the communication method of the present disclosure may refill and use the toner without replacing the toner cartridge. In addition, even when an error in the refilling process occurs, it is possible to reuse the toner refill apparatus when the same is used again in the same image forming apparatus. Furthermore, since the communication method of the present disclosure uses the group information 10, it is possible to share one toner refill apparatus in a plurality of image forming apparatuses. Further, in the communication method of the present disclosure, a more accurate injection amount may be determined by receiving the toner injection amount from the user.

FIG. 9 is a flowchart to describe a toner refill operation according to an example. In more detail, the following example describes a case where the sharing function of the toner refill apparatus is not set.

Referring to FIG. 9, if the toner refill apparatus is connected to the toner cartridge in operation S910, information stored in the memory chip of the toner refill apparatus is read to determine whether the device is genuine in operation S920.

If the device is determined as not genuine in operation S920-N, it is displayed that toner refilling is not performed in operation S970, and toner refill operation may be terminated.

Conversely, if genuineness is determined in operation S920-Y, it is determined whether the toner refill apparatus has been previously connected with the image forming apparatus in operation S930.

If the connection history is not found in operation S930-N, the information of the image forming apparatus is stored in the memory chip 410 of the toner refill apparatus in operation S940, and the toner refilling operation may be performed in operation S960.

If there is connection history in operation S930-Y, it is determined whether the information of the image forming apparatus stored in the memory chip is the same as the information of the image forming apparatus in operation S950.

If it is determined that information is not the same in operation S950-N, a message indicating that the toner refill apparatus is not usable is displayed in operation S970, and the refill operation may be terminated.

If it is determined that the information is the same in operation S950-Y, the toner refill operation may be processed in operation S960.

As described above, according to the toner refilling method of this example, the toner may be refilled without replacing the toner cartridge, thereby improving the economical efficiency. Further, the information of the image forming apparatus is stored in the toner refill apparatus, and it may be easily determined whether or not the corresponding toner refill apparatus is used in the other image forming apparatus using the toner refill apparatus or the same image forming apparatus.

FIG. 10 is a flowchart to describe a toner refill operation according to an example. In more detail, the following example describes a case where the sharing function of the toner refill apparatus is set.

Referring to FIG. 10, if the toner refill apparatus is connected to the toner cartridge in operation S1010, information stored in the memory chip of the toner refill apparatus is read to determine whether the device is genuine in operation S1020.

If genuineness is not determined in operation S1020-N, it may be displayed that toner refill cannot be performed in operation S1090, and toner refill operation may be terminated.

Conversely, if genuineness is determined in operation S1020-Y, it is determined whether the toner sharing function in the image forming apparatus is activated in operation S1030.

If a toner sharing function is not activated in operation S1030-N, whether the toner refill apparatus is used may be determined in operation S1040 in the same manner as FIG. 9 and the toner refill operation may be processed.

If the toner sharing function is activated in operation S1030-Y, whether sharing information is stored in the memory chip 410 of the connected toner refill apparatus is determined in operation S1050.

If the group information 10 is not stored in operation S1050-N, it may be determined whether or not there is a history that the toner refill apparatus has connected to the image forming apparatus. Even if there is no connection history, the information of the image forming apparatus and the group information 10 is stored in the memory chip 410 in operation S1060, and the toner refilling may be performed in operation S1080.

On the contrary, if the group information 10 is stored in operation S1050-Y, it is determined whether the group information 10 stored in the memory chip 410 and the group information 10 stored in the image forming apparatus 100 are identical in operation S1070. If it is determined that it is usable in the same case, and the toner refilling may be performed in operation S1080.

If the group information 10 stored in the memory chip and the group information 10 stored in the image forming apparatus are determined to be different in operation S1070-N, it is determined that the toner refilling may not be performed and a message may be displayed in operation S1090.

As described above, the toner refilling method according to this example utilizes the group information 10, and it is possible to share one toner refill apparatus in a plurality of image forming apparatuses.

FIG. 11 is a flowchart to describe a communication method of an electronic device according to an example.

Referring to FIG. 11, a plurality of image forming apparatuses are selected in operation S1110. For example, a plurality of image forming apparatuses connectable to the user may be displayed, and image forming apparatuses to which the toner refill apparatus is used together among the plurality of image forming apparatuses displayed may be selected. At the time of implementation, the electronic device 500 may automatically select a device using the same toner among connectable image forming apparatuses.

The group information 10 is generated in operation S1120. For example, a keyword, a number, or the like to be used as the group information 10 may be input from the user, a random value may be generated by the electronic device 500 itself, or an arbitrary key value may be generated using the information of the electronic device 500.

The generated group information 10 may be transmitted to each of the selected image forming apparatuses in operation S1130.

When the user photographs the QR code of the toner cartridge using the electronic device 500 after the transmission of the group information 10, the operation of displaying the manual information may be performed. The operation of transferring the calculated or inputted amount of toner to the image forming apparatus 100 may be additionally performed, if toner amount is input from a user or a photo before and after toner refilling of the toner refill apparatus is photographed.

Therefore, an example communication method of an electronic apparatus generates group information and provides the group information to an image forming apparatus using the group information. Thus, it is possible to share and use a toner refill apparatus. An example communication method of an electronic apparatus provides various information related to the method of using the toner refill apparatus, so that a user may more easily perform the toner refill operation.

Further, a communication method of an electronic device determines an amount of injected toner by using a photographed image, or provides the amount of injection inputted from a user to an image forming apparatus, and thus, a toner amount may be determined more accurately.

Although the examples of the present disclosure have been illustrated and described hereinabove, the present disclosure is not limited to the above mentioned examples, but may be variously modified by those skilled in the art to which the present disclosure pertains without departing from the scope and spirit of the present disclosure as disclosed in the accompanying claims. These modifications should also be understood to fall within the scope of the present disclosure.

The invention claimed is:

1. An image forming apparatus comprising:

a print engine to perform a printing job using toner filled in a toner cartridge;

a communicator to communicate with a memory chip attached to a toner refill apparatus which refills the toner cartridge with toner;

a memory to store group information corresponding to a plurality of image forming apparatuses for sharing the toner refill apparatus; and a processor to determine whether or not the toner refill apparatus is usable based on information stored in a memory chip of the toner refill apparatus and group information stored in the memory.

2. The image forming apparatus of claim 1, wherein the processor, when group information which is the same as group information stored in the memory is stored in the memory chip, confirms that the toner refill apparatus is usable.

3. The image forming apparatus of claim 1, wherein the processor, when identification information of the image forming apparatus is stored in the memory chip, confirms that the toner refill apparatus is usable.

4. The image forming apparatus of claim 1, wherein the processor, when group information is not stored in the memory chip, stores group information stored in the memory in the memory chip.

5. The image forming apparatus of claim 1, wherein the processor, when identification information of the image forming apparatus is not stored in the memory chip, stores identification information of the image forming apparatus in the memory chip.

6. The image forming apparatus of claim 1, further comprising:

a display to display a user interface (UI) window to receive a toner injection amount when it is determined that the toner refill apparatus is usable; and an input device to receive the injected toner amount, wherein the processor updates a toner amount filled in the toner cartridge based on the injected toner amount.

7. The image forming apparatus of claim 1, further comprising:

a communicator to receive information on a toner amount injected to the toner cartridge from an electronic apparatus, wherein the processor updates a toner amount filled in the toner cartridge based on the received toner amount.

8. The image forming apparatus of claim 1, further comprising:

a communicator to receive the group information from an electronic device, wherein the processor stores the received group information in the memory.

9. The image forming apparatus of claim 1, wherein the processor authenticates the toner refill apparatus using information prestored in the memory chip, and confirms whether the authenticated toner refill apparatus is usable.

10. The image forming apparatus of claim 9, further comprising:

a display to display an authentication result.

11. The image forming apparatus of claim 1, wherein the processor, when a toner refilling process is being performed, stores information indicating that toner refilling is being performed in the memory.

12. The image forming apparatus of claim 11, wherein the processor, when the toner refilling process is completed, removes the information indicating that toner refilling is being performed from the memory.

13. The image forming apparatus of claim 11, wherein, when the information indicating that toner refilling is being performed is stored in the memory during a booting of the image forming apparatus, the processor determines that an error has occurred.

14. The image forming apparatus of claim 13, wherein, based on determining that the error has occurred, the processor determines that the toner refilling process is to be re-performed.

15. A toner refill apparatus, comprising:

a bottle to store toner;

an inlet to move the stored toner to a toner cartridge, the inlet being disposed at one side of the bottle; and a memory chip to store device information of the toner refill apparatus and use history information, the memory chip being disposed in the bottle, wherein the memory chip, when the toner refill apparatus is connected to an image forming apparatus having group information corresponding to a plurality of image forming apparatuses for sharing the toner refill apparatus, stores the group information.

16. The toner refill apparatus of claim 15, wherein the use history information, when the toner refill apparatus is connected to the image forming apparatus, has a value that changes.

17. The toner refill apparatus of claim 11, wherein the memory chip comprises:

a memory to store device information and the use history information of the toner refill apparatus; and a plurality of terminals which electrically connect the memory and the image forming apparatus.

18. A communication method of an image forming apparatus, the communication method comprising:

storing group information which corresponds to a plurality of image forming apparatuses for sharing a toner refill apparatus for refilling a toner cartridge of each image forming apparatus with toner;

receiving information stored in a memory chip attached to the toner refill apparatus; and confirming whether the toner refill apparatus is usable based on the stored group information and information stored in a memory chip of the toner refill apparatus.

* * * * *